United States Patent [19]

Nichols, Jr.

[11] 4,146,362

[45] Mar. 27, 1979

[54] MULTI-DYE TEXTILE DYEING PROCESS

[75] Inventor: David B. Nichols, Jr., Dalton, Ga.

[73] Assignee: RCA Corporation, New York, N.Y.

[21] Appl. No.: 851,418

[22] Filed: Nov. 14, 1977

[51] Int. Cl.[2] ..... D06P 1/00

[52] U.S. Cl. ..... 8/1 XB; 8/14; 8/15

[58] Field of Search ..... 8/1 XB, 14, 15

[56] References Cited

U.S. PATENT DOCUMENTS

| | | | |
|---|---|---|---|
| 2,359,776 | 10/1944 | Milne et al. | 8/65 |
| 3,220,793 | 11/1965 | Parson et al. | 8/14 |
| 4,010,709 | 3/1977 | Sayman et al. | 8/1 XB |

FOREIGN PATENT DOCUMENTS 1363129 8/1974 United Kingdom.

*Primary Examiner*—A. Lionel Clingman
*Attorney, Agent, or Firm*—H. Christoffersen; Samuel Cohen; William Squire

[57] ABSTRACT

A first dye is applied to spaced regions of a tufted carpet and a second dye is then applied to a substantially larger area of the dye including the spaced regions covered by the first dye. The second dye is absorbed by the carpet in the regions outside of the already dyed regions. But the second dye has a viscosity sufficiently lower than the viscosity of the first dye that the fibers in the spaced regions are substantially masked from and substantially do not absorb the second dye. The carpet is then steamed to fix the dyes to the yarn.

14 Claims, No Drawings

MULTI-DYE TEXTILE DYEING PROCESS

The present invention relates to the dyeing of textile materials especially carpeting with a multi-color dye.

A multi-color dyeing carpet process includes various carpet dyeing apparatuses arranged in a line for sequentially depositing dyestuff on a continuously moving carpet material. One such dyeing apparatus is disclosed in my copending application Ser. No. 661,396, filed Feb. 25, 1976, and assigned to the assignee of the present invention. Disclosed therein is a process including a TAK head for depositing droplets of the dyestuff on the carpet tufts. The TAK head includes two separate TAK head dye depositing mechanisms hereinafter referred to as TAK heads 1 and 2 for depositing first and second different dyes sequentially to the carpet tufting as it passes beneath the TAK heads. The TAK heads are a conventional apparatus disclosed in more detail in U.S. Pat. Nos. 3,683,649; 3,800,568; 3,726,640 and 3,731,503. The TAK head is an apparatus for dispersing dyestuff droplets onto upstanding tufts of carpet or other textile material. While carpet is disclosed in the preferred embodiment it will be equally apparent that other textile materials can also be dyed with the instant invention.

A second dyeing apparatus is in-line with the TAK head downstream from the two dye depositing mechanisms for depositing a continuous dye film of a width equal to that of the carpet as it continuously moves beneath the film. This apparatus comprises a dye pan in which is immersed a roller of the same width as the carpet. A doctor blade picks the dye off the rotating roller and deposits the dye in a moving film onto the upstanding tufts of the carpet passing beneath the doctor blade. This applicator manufactured by the Kuster Company is known in the carpet industry as a "Kuster" applicator. This applicator, which is third in the line, is positioned downstream from the TAK heads 1 and 2 at the same level with and just prior to a steamer unit for fixing the dyes to the carpet. These particular apparatus are well-known in the carpet dyeing field and need not be described in detail herein.

A process embodying the invention for dyeing a carpet or other textile material may employ apparatus similar to that described above. However, as contrasted to prior methods, in the present process first a relatively viscous dye is deposited on spaced regions of the material and then a substantially less viscous dye is employed for regions which include the spaced regions.

In wide spread use are nylons and other synthetic materials as yarns for fabrication of carpet tufting. Acid dyes are most satisfactory with nylon materials. These dyes are water soluble and may have a PH of about 3. These acid dyes have a water carrier and are thickened with a vegetable gum for providing the desired viscosity for the fluid. Chemicals forming the coloring of a given dye solution can be formulated from primary coloring chemicals in any desired proportion to form a given color. The listing of commercially available acid dyes may be found in a magazine, Textile Chemists and Colorists, July, 1976, Volume 8, No. 7A, published by the American Association of Textile Chemists and Colorists, (AATTC). The acid dyes are noted in table 4, pages 73–78. A particular color is formulated by selecting a number of the colors that are commercially available, mixing them in a given desired proportion with a desired volume of water, and a vegetable gum base to form a liquid dye solution. The mixing of three primary colors for example, yellow, red and blue in different proportions produces any desired color in accordance with those selected proportions. The formulation of each such dyes are well known. The manufacturer of the particular colors are listed in the aforementioned magazine.

In carrying out the process of the present invention, the two TAK heads 1 and 2 are loaded with a relatively viscous first and second dyes, of the same or different colors while the downstream Kuster dye applicator is loaded with a relatively lighter, less viscous third dye. In practice, the viscosity of the first and second dyes dispersed in scattered areas over the carpet surface in droplets by the upstream TAK heads 1 and 2 is preferably in the range of 400 to 20,000 centipoise (CPS) while the viscosity of the third dye in the Kuster applicator is about 1/100 of this value. While the first and second dyes in the preferred embodiment are applied to the upstanding carpet tufts in scattered droplets, these dyes may instead be deposited by some other form of applicator such as a print roller, as an example. While the dyes disclosed herein are water soluble acid dyes, for use with nylon yarns, it should be understood that for other materials, other types of dyes that are suitable for these materials may be used instead. Generally, the third dye applied by the Kuster applicator is deposited as a film that has a viscosity in a range from 5 to 10 CPS while the first and second have a viscosity of about 600 CPS. The first, second and third dyes are made of compatible chemicals and carrier mediums.

In practice a minimum difference of viscosity of about 100 to 1 between the first and second dyes and the third dye results in optimum rejection of the third dye by yarns initially dyed with the first and second dyes. Since the dyes are compatible and can blend together if at the same viscosity, then as the viscosities of the first and second dyes as compared to the third dye come close to one another, in value, the yarn dyed with the first and second more viscous dyes becomes more receptive to the third thinner dye. Therefore, various degrees of receptivity of the third dye by yarns dyed with the first and second dyes can be provided by setting the viscosity ratio at some desired value less than 1/100. Such ratios provide various degrees of blending of one dye with the other if such an effect is desired.

Any number of different dyes can be applied sequentially. In the preferred embodiment, the two TAK heads 1 and 2 are loaded with dyes of the same viscosity while the third downstream Kuster applicator applies a dye of much lower viscosity. However, in the alternative, there can be single TAK head for applying the more viscous dye upstream of the less viscous dye Kuster applicator. Further, print rollers can be used with or in place of one or both the TAK heads or the Kuster applicator. Thus, many permutations of applicators in type and number can be provided. The only sequence which is of significance is that the more viscous dye be applied over certain portions of the carpet and the less viscous dye be applied subsequently over the carpet areas including the portions dyed with the more viscous dye. The less viscous dye has little or no dying effect on the yarns saturated with more viscous dye. Due to the randomness of the application of the dye by a TAK head, some yarns may not be completely saturated with the more viscous dye. These yarns will be receptive to both dyes. That is, some yarn strands which, for example, only receive a relatively small dye droplet of the more viscous dye may take up and be affected by the later applied less viscous dye. Such strands, after the dyes are fixed, will be multi-colored.

Preferably, the carpet is pre-treated prior to application of any of the dyestuff. But this is optional. Pretreatment may include pre-steaming the carpet and then submerging it in a water solution containing a chemical wetter such as ethoxylated aliphatic alcohol with or without acid or with or without an alkaline. The carpet then may be squeezed to a "wet pick-up" preferably between 50 to 150 percent of the water and chemical wetter solution. Other ranges of pick-up can be used in accordance with a particular process sequence. The expression "wet pick-up" refers to the weight of liquid in a piece of textile material compared to the dry weight of that piece of textile material.

What is significant in the practice of the method embodying the invention is the relative viscosities of the dyes sequentially applied to carpet tufts. The later applied dye must be of substantially lower dye viscosity than the earlier applied dye. The manner of applying the dye is not critical. It is the difference in dye viscosities which results in the lower viscosity subsequently applied dye not being accepted by the dye impregnated areas of the tufts covered with the initially applied more viscous dye. That is, there is substantially no visably effective absorption of the low viscosity dye by those yarns which are impregnated with the higher viscosity dye. Therefore, no care need be taken to provide registration of the second dye only in areas not covered by the first dye. In fact, very pleasing coloring affects are achieved by saturating the entire carpet with a film or sheet of the subsequently applied low viscosity dye to provide a background color whereas the earlier applied high viscosity dye provides a patterned coloring effect. Ordinarily dyes of the same viscosity and similar composition would tend to mix resulting in two subsequently applied dyes to the same carpet tufts mixing and blending and destroying the color of each of the dyes as an individual separate color. As provided in accordance with the present invention the applying of a significantly more viscous dye initally in selected areas of the carpet tufts and then subsequently applying the thinner less viscous dye to the entire carpet provides a full range of coloring effects not heretofore possible.

Subsequent to applying the relatively thin last applied dyestuff to the carpet, the carpeting is transported into a steamer apparatus suitable for the particular dye technique. The steamer apparatus fixes the dye to the carpeting and washes away undesirable matter accumulating in the dyeing process. The fixing of the dye is conventional.

Following are three specific examples of processes embodying the invention:

EXAMPLE 1

Carpet backing material tufted with nylon yarn in a 12 foot width.

First the carpet was treated with the following prewet solution:

4.09kg of "Pomoco JW" a trade name of Piedmont Chemical Industries, Incorporated, NC, which is a long chain fatty alcohol amide with anionic surfactant.

6.81kg of "Chemcoloft 75-N", a trade name of the Chemical Processing of Georgia Company which is a fabric softener formed of a fatty imidazoline polyethylene emulsion.

0.6kg "Quadefome MA" which is a trade name of the Quaker Chemical Corporation, NC, which is a modified silicone base formed of silicone and chlorinated parafin used as a defoamer.

The ingredients above were dissolved in sufficient water to produce a 3,000 lb. mixture having a PH of 7. This solution was placed in a pad applicator. The carpet was run at 27 feet per minute through the pre-wet solution in the pad applicator with 30 lbs. of roller pressure on the pre-wet carpet providing 140 percent pick-up of the pre-wet solution.

| TAK HEAD 1 (SUBSEQUENT TO PRE-WET) FIRST DYE | | | |
|---|---|---|---|
| 0.024 | kilograms | Acid Yellow | 198 |
| 0.036 | kilograms | Acid Red | 337 |
| 0.180 | kilograms | Acid Blue | 277 |
| 2.72 | kilograms | "Progowet FS" a trade name of the Chemical Process of Georgia Company which is an Ethoxylated Aliphatic Alcohol | |
| 2.72 | kilograms | Formic Acid | |
| 5.6 | kilograms | Vegetable Gum (of the type disclosed in my aforementioned copending patent application (Guarbean) | |
| 0.4 | kilograms | "Quadefome MA" | |

The above ingredients were mixed at room temperature with water to make a 2,000 lb. mixture having a PH of 3 and a viscosity of 600 CPS.

This formed the first dye which was dispersed onto upstanding carpet tufts (transported horizontally beneath TAK head 1) in droplet form by the first upstream TAK head 1 subsequent to pre-wetting the carpet.

The second color was formed as follows:

| TAK HEAD 2, SECOND DYE | | | |
|---|---|---|---|
| 0.0024 | kilograms | Acid Yellow | 198 |
| 0.00048 | kilograms | Acid Red | 337 |
| 0.024 | kilograms | Acid Blue | 277 |
| 2.72 | kilograms | Progowet FS | |
| 2.72 | kilograms | Formic Acid | |
| 5.6 | kilograms | Vegetable Gum | |
| 0.4 | kilograms | Quadefome MA | |

The above ingredients were mixed at room temperature with water to make a 2,000 lb. mixture having a PH of 3 and a viscosity of 600 CPS. This material was deposited onto the upstanding carpet tufts by the second TAK dye head downstream from the first TAK dye head. Downstream from the two TAK heads was a Kuster applicator for applying a sheet film of a dye formulated as follows:

| KUSTER APPLICATOR, THIRD DYE | | | |
|---|---|---|---|
| 0.130 | kilograms | Acid Yellow | 198 |
| 0.097 | kilograms | Acid Red | 337 |
| 0.900 | kilograms | Acid blue | 277 |
| 3 | kilograms | Acetic Acid | |
| 0.25 | kilograms | "H-100" a trade name of WACO Chemical Company of Dalton, Georgia, which is a chelating agent or water softener, comprising Ethylene Diamine Tetra Acetic Acid (EDTA) | |
| 2.5 | kilograms | Vegetable Gum | |

The above ingredients were mixed at room temperature with water to make a 5,000 lb. mixture having a PH of 7 and a viscosity of 5–10 CPS. This mixture was applied to the entire carpet as a film at a 355 percent pick-up. The speed of the Kusters dye applicator roller was 20 RPM. The carpet with the three dyes was then transported while horizontal into a steamer unit for fixing the dyes to the yarns.

EXAMPLE 2

Carpet backing tufted with nylon yarn in a 12 foot width. Pre-wet mixture was the same as in example 1 at 140 percent pick-up.

| TAK HEAD 1, FIRST DYE | | | |
|---|---|---|---|
| 0.288 | kilograms | Acid Yellow | 198 |
| 0.180 | kilograms | Acid Red | 337 |
| 0.084 | kilograms | Acid Blue | 277 |
| 2.72 | kilograms | Formic Acid | |
| 2.72 | kilograms | "Progowet FS" | |
| 5.6 | kilograms | Vegetable Gum | |
| 0.4 | kilograms | "Quadefome MA" | |

The above ingredients were mixed at room temperature with water to make 2,000 lb. mixture at a viscosity of 600 CPS and a PH of 3 and deposited onto the carpet by TAK head 1.

| TAK HEAD 2, SECOND DYE | | | |
|---|---|---|---|
| 0.025 | kilograms | Acid Yellow | 198 |
| 0.025 | kilograms | Acid Red | 337 |
| 0.030 | kilograms | Acid Blue | 277 |
| 2.72 | kilograms | "Progowet FS" | |
| 2.72 | kilograms | Formic Acid | |
| 5.6 | kilograms | Vegetable Gum | |
| 0.4 | kilograms | "Quadefome MA" | |

The above ingredients were mixed at room temperature with water to make a 2,000 lb. mixture at a viscosity of 600 CPS and PH of 3 and deposited onto the carpet by TAK head 2 after the depositing of the first dye by TAK head 1.

| KUSTER APPLICATOR, THIRD DYE | | | |
|---|---|---|---|
| 1.56 | kilograms | Acid Yellow | 198 |
| 0.87 | kilograms | Acid Red | 337 |
| 0.51 | kilograms | Acid Blue | 277 |
| 3 | kilograms | Acetic Acid | |
| 0.25 | kilograms | "H-100" | |
| 2.5 | kilograms | Vegetable Gum | |

The above ingredients were mixed at room temperature with water to make a 5,000 lb. mixture having a viscosity of 5–10 CPS and a PH of 7. This dye was applied as a film over the entire carpet at 355 percent pick-up.

Steaming, carpet speed, pad pressure and dye applicator roller speed were the same as in example 1.

EXAMPLE 3

Pre-wet same as example 1, 140 percent pick-up. Carpet backing tufted with nylon yarn in a 12 foot width.

| TAK HEAD 1, FIRST DYE | | | |
|---|---|---|---|
| 2.16 | kilograms | Acid Yellow | 198 |
| 0.48 | kilograms | Acid Red | 337 |
| 0.06 | kilograms | Acid Blue | 277 |
| 2.72 | kilograms | "Progowet FS" | |
| 2.72 | kilograms | Formic Acid | |
| 5.6 | kilograms | Vegetable Gum | |
| 0.4 | kilograms | "Quadefome MA" | |

The above ingredients were mixed at room temperature with water to make a 2,000 lb. mixture having a viscosity of 600 CPS and a PH of 3 and deposited on the carpeting by TAK head 1.

| TAK HEAD 2, SECOND DYE | | | |
|---|---|---|---|
| 0.072 | kilograms | Acid Yellow | 198 |
| 0.035 | kilograms | Acid Red | 337 |
| 0.024 | kilograms | Acid Blue | 277 |
| 2.72 | kilograms | "Progowet FS" | |
| 2.72 | kilograms | Formic Acid | |
| 5.6 | kilograms | Vegetable Gum | |
| 0.4 | kilograms | "Quadefome MA" | |

The above ingredients were mixed at room temperature with water to make a 2,000 lb. mixture having a viscosity of 600 CPS and a PH of 3 and deposited on the carpeting by TAK head 2 downstream from TAK head 1.

| KUSTER APPLICATOR, THIRD DYE | | | |
|---|---|---|---|
| 6.0 | kilograms | Acid Yellow | 198 |
| 3.6 | kilograms | Acid Red | 337 |
| 0.36 | kilograms | Acid Blue | 277 |
| 3 | kilograms | Acetic Acid | |
| 0.25 | kilograms | "H-100" | |
| 2.5 | kilograms | Vegetable Gum | |

The above ingredients were mixed at room temperature with water to make a 5,000 lb. mixture having a viscosity of 5–10 CPS and a PH of 7. This dye was applied as a sheet over the entire carpet with 355 percent pick-up after the first and second dyes were applied. Carpet speed, pad pressure, applicator roller speed, and steaming were the same as in example 1.

Nylon carpeting produced in accordance with the three examples noted above produced multi-colored hues in which the dyes colored by the TAK heads 1 and 2 were separately visible after the entire carpet was coated with a film of dye from the Kuster applicator. The over-all impression was that of a pleasing multi-hued effect. The first and second dyes where overlapping blended together to form multi-hued effects.

It is to be understood that the particular compositions or numbers of dyes used in the three examples above are not critical to the invention. While the dyes formulated in the examples above were made with a water base, it will be equally apparent that the dyes of other base fluids having different viscosities could also yield similar effects.

What is claimed is:

1. A continuous process for dyeing a textile material comprising:

applying a first dye liquor to a first portion of the surface of the material, the first dye liquor having a first viscosity, applying a second dye liquor to a second portion of the surface greater in area than and including the first portion while still wet with the first dye liquor, the second dye liquor having a second viscosity sufficiently lower than the first viscosity and being otherwise compatible with the first dye liquor so that the first dye liquor effectively masks the first portion to prevent the first portion from absorbing the second dye liquor, the second dye liquor being absorbed by and dyeing the surface outside the first portion, whereby the colors of the dye liquors are separately visible on the textile material, and fixing the dyes in the first and second dye liquors to the textile material.

2. The process of claim 1 wherein the second dye liquor has a viscosity that is at most 10 percent of the viscosity of the first dye liquor.

3. The process of claim 1 wherein the second dye liquor has a viscosity that is at most one percent of the viscosity of the first dye liquor.

4. The process of claim 1 wherein the first dye liquor has a minimum viscosity of about 600 cps and the second dye liquor has a viscosity of about 5–10 cps.

5. A process for dyeing a textile material comprising:

submerging the textile material in a pre-wet solution, squeezing a portion of the pre-wet solution from the textile material, applying a first water base, gum thickened dye liquor to a portion of the surface of the textile material, the dye liquor having a first viscosity, transporting textile material wet with the dye liquor, applying a second water base, gum thickened dye liquor to the surface including the portion during the transporting, the second dye liquor having a second viscosity substantially less than the first viscosity and being otherwise compatible with the first dye liquor so that the first dye liquor effectively masks the first portion to prevent the first portion from absorbing the second dye liquor, the second dye liquor being absorbed by and dyeing that portion of the surface not absorbing the first dye liquor, and steaming the textile material to fix the dyes in the liquors to the textile material.

6. The process of claim 5 wherein the ratio of the first and second viscosities is at least 10:1.

7. The process of claim 5 wherein the ratio of the first and second viscosities is at least 100:1.

8. The process of claim 5 wherein the first viscosity is in the range of 400 to 20,000 cps.

9. A continuous nylon carpet dyeing process comprising:

applying a first water base, gum thickened acid dye liquor to a surface of the carpet at spaced postions on the carpet surface, the first dye liquor having a first viscosity, applying a second water base, gum thickened acid dye liquor to the carpet wet with the first dye liquor over the entire surface of the carpet including the spaced positions, the second dye having a second viscosity sufficiently lower than the first viscosity such that the carpet does not effectively absorb the second dye at the spaced positions, and fixing the dyes in the dye liquors to the carpet.

10. The process of claim 9 wherein the ratio of the first and second viscosities is at least about 100:1.

11. The process of claim 9 further including the step of applying a third dye liquor at spaced positions on the carpet after applying the first dye liquor and before applying the second dye liquor, the third dye liquor having a viscosity of about the same as that of the first dye liquor.

12. The process of claim 9 wherein the first dye liquor applying step includes applying the first dye liquor in droplet form onto the carpet and the second dye liquor applying step includes applying the second dye liquor in sheet form over the carpet.

13. The process of claim 9 further including transporting the carpet continuously during the applying of the first and second dye liquors and the fixing steps.

14. A continous process for dyeing a tufted carpet comprising:

applying drops of first and second dye liquors of different colors, one after the other, to the tufted surface of the carpet, both dye liquors having about the same viscosity, then applying a third dye liquor relatively less viscous than the first and second dye liquors over the entire tufted surface of the carpet, the third dye liquor viscosity being sufficiently lower than the viscosities of the first and second dye liquors and being otherwise compatible with the first and second dye liquors so that the tuft portions receiving the first and second dye liquors are effectively masked from the third dye liquor, and fixing the dyes in the dye liquors to the carpet tufts.

* * * * *